United States Patent [19]

Pezold

[11] Patent Number: 4,615,501

[45] Date of Patent: Oct. 7, 1986

[54] ACCORDION TYPE HOSE HOLDER

[76] Inventor: Ralph W. Pezold, 712 W. 20th St., Sanford, Fla. 32771

[21] Appl. No.: 728,389

[22] Filed: Apr. 29, 1985

[51] Int. Cl.[4] ..... B05B 13/02

[52] U.S. Cl. ..... 248/75; 248/231.1; 248/339; 206/493; 206/802

[58] Field of Search ..... 248/75, 49, 231.1, 354.1, 248/309.2, 339, 578, 145.6; 134/166 C; 206/493, 802, 310, 394, 403, 407

[56] References Cited

U.S. PATENT DOCUMENTS 1,459,192 6/1923 Bell ..... 248/145.6 X
4,054,149 10/1977 Nelson ..... 248/75 X
4,161,182 7/1979 Burton ..... 248/75 X
4,231,595 11/1980 Knutsen ..... 137/355.16 X

*Primary Examiner*—Ramon S. Britts
*Assistant Examiner*—Karen J. Chotkowski
*Attorney, Agent, or Firm*—Macdonald J. Wiggins

[57] ABSTRACT

A holder for an accordion type hose for connecting a recreational vehicle plumbing system to a central sewage processing system having an elongated cylindrical core, a fixed circular disk concentrically attached to one end thereof, a removable circular disk selectively attachable to the other end thereof, and a handle attached to the fixed disk end thereof. An accordion type hose is collapsed and the core inserted therethrough. The removal disk is attached such that the hose is captivated between the two disks.

11 Claims, 3 Drawing Figures

ACCORDION TYPE HOSE HOLDER

BACKGROUND OF THE INVENTION

1. Field of the Invention

The present invention relates to sewer connection hoses for recreational vehicles, and more particularly to a device for holding such hoses when not in use.

2. Description of the Prior Art

Recreational vehicles generally have self-contained bathrooms utilizing storage tanks or processing systems. When the vehicle is parked such as in a recreational vehicle park or the like, an accordion type hose is connected to an outlet from the internal bathrooms and sewage system of the recreational vehicle. The other end of the hose is connected to the sewage processing system of the park. When the recreational vehicle is to depart, the hose must be disconnected at each end, flushed out, and stored in some fashion in the vehicle. It is common to have a storage compartment into which the hose is placed. However, due to the flexibility of the hose this task is often messy and disagreeable.

There have been attempts in the past to provide a more convenient method or system of storing the hose. For example in U.S. Pat. No. 4,133,347 to Mercer, an elongated cylindrical fitting, which connects to the waste outlet of the vehicle, has the accordion like hose stowed inside of the elongated fitting with a cap on the distal end of the hose. It is of course necessary for the diameter of the cylindrical fitting to be larger than the diameter of the hose, creating an even more bulky package which must be stored in the recreational vehicle. A similar device is shown in the patent to Knutsen, U.S. Pat. No. 4,231,595 in which a housing structure is provided into which the hose is stored when not in use. Again, a very bulky and awkward to handle device is disclosed.

There is a need for a simple, low cost hose holder which will occupy a minimum of space in the vehicle and which will be easy to handle.

SUMMARY OF THE INVENTION

A characteristic of the accordion type sewage connector hose used to connect a recreational vehicle to a fixed sewage treatment system is that the hose is very short when fully retracted yet will extend when fully open to a length of about ten times that of its retracted length. A sewage hose is available under the tradename Deflect-O® in various lengths. For example, the 20 foot length hose is compressible to about two feet. The end of the hose which connects to the recreational vehicle sewage system has a quick connect coupling attached thereto and the other end is usually inserted into a larger diameter pipe of the central sewage system. To store a hose of this type, I provide a spool-like holder having a removal end cap disk. The core of the spool is of a diameter to be inserted into the hose in its collapsed or retracted condition. The length of the core is selected to be approximately that of the compressed length of the hose. The core includes a fixed end cap disk attached to the proximal end of the core. In use, the core is inserted into the hose, the hose collapsed to its shortest length such that the collapsed hose is completely on the core. The removable end cap disk is then attached to the distal end of the core captivating the collapsed hose. Although numerous methods will be apparent to attach the removable end cap disk, I prefer to use an axially disposed rod through the core connected to a handle at the proximal end and having a threaded portion projecting through the distal end of the core.

The removable end cap disk includes a central hole which may be placed over the threaded rod and a thumb screw or the like screwed onto the rod to hold the end cap in place. Advantageously, the fixed end cap disk and the removable end cap disk have diameters slightly larger than the outside diameter of the hose with the fixed end cap disk. Preferably, the coupling end of the hose is disposed over the fixed disk. As will now be understood, the long bulky hose has been compressed into a compact cylinder and stored on the spool of the invention. The complete assembly or package can now be conveniently handled by grasping the handle which may be in the form of a ring. The unit may be placed in a compartment or the handle can be hung in an appropriate location.

When it is desired to use the hose, the removable end cap disk is removed and the core easily removed from the hose. The coupling at the proximal end is then connected to the recreational vehicle waste outlet, and the free end of the hose is inserted into the inlet to the central sewage system.

Although the spool may be formed from any suitable material, I prefer to use PVC pipe to form the core and sheet PVC material to form the end caps.

It is therefore a principal object of my invention to provide a simple, low cost storage device for storing accordion type hose.

It is another object of my invention to provide a storage device for accordion type sewage connection hose used with recreational vehicles, the device having a spool-like arrangement with a core which is inserted through the hose in its retracted condition.

It is still another object of my invention to provide a storage device for accordion type hose which is easy to handle, upon which it is easy to install the hose, and easy to remove the hose.

These and other objects and advantages of my invention will become apparent from the following detailed description when read in conjunction with the drawings.

DETAILED DESCRIPTION OF THE PREFERRED EMBODIMENT

Figure 1:
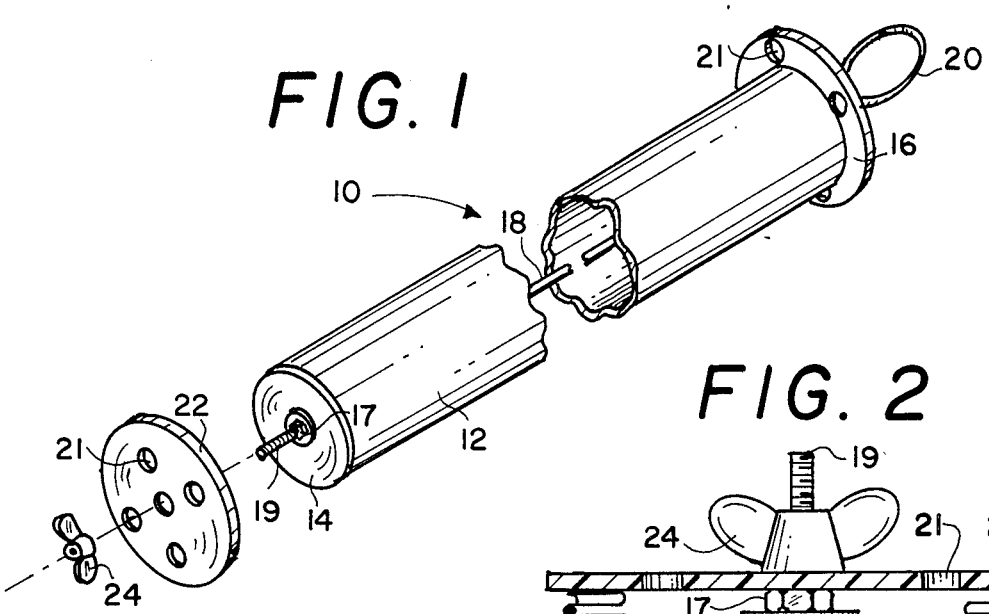
FIG. 1 is a perspective view of the hose holder of my invention shown in condition to install a hose thereon.

Referring to FIG. 1, the hose holder of the invention, shown generally at 10, is seen in condition for installing a collapsed accordion type hose thereon. The holder 10 includes a cylindrical core 12, preferably formed from plastic tubing such as PVC or the like. Core 12 is shown broken to indicate indeterminate length, with the length selected in accordance with the length of the hose to be stored. A fixed end cap disk 16 is cemented to the proximal end of core 12 and the distal end of core 12 is closed by a cap disk 14 having the same diameter as core 12 cemented thereto. A rod 18 is disposed longitudinally and axially through core 12 projecting from both the proximal end and the distal end. Distal end 19 of rod 18 is threaded to accept a washer and nut 17 while the proximal end of rod 18 has a handle 20 attached thereto. Disks 16 and 22 each include a plurality of holes 21 therethrough which permit a flow of air through an installed disk as discussed hereinbelow.

Figure 2:
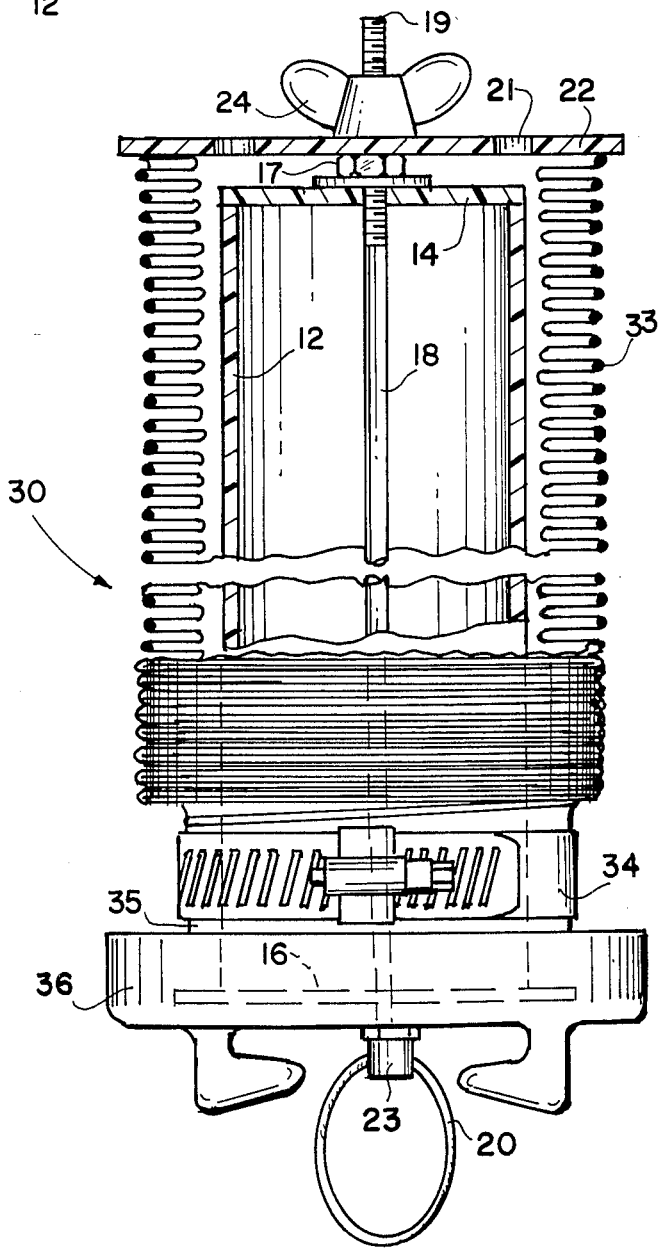
FIG. 2 is the holder of FIG.1 shown with a collapsed hose installed in which a portion of the holder and the hose is shown in cross section.

A removable end cap disk 22 is provided having an opening in the center thereof for installation over distal end 19 of rod 18. When disk 22 is installed, it may be held in place by a wing nut 24 threaded onto distal end 19. As will be noted, when disk 22 is installed, a spool-like device is provided. To use the holder 10, a collapsed hose is installed on core 12 and end cap disk 22 is installed and attached with thumb screw 24. Turning to FIG. 2, such an installation is illustrated.

As previously discussed, holder 10 is designed to be used in conjunction with an accordion type hose used for connecting the waste outlet from a recreational vehicle to a central sewage treatment system. As is well known, a hose 30 has a bellows type construction such that it can be longitudinally extended to a maximum length and is retractable to a minimum length. Such hoses generally have a waterproof covering 32 formed from a material such as vinyl in which a steel spring 33 is embedded to develop the accordion form. The proximal end of hose 30 is attached to a coupling 36. As shown in FIG. 2, coupling 36 may be of the bayonet type which attach to a connection having pins which are engaged by hook portions of connectors 36. Connector 36 includes a collar 35 over which an end of the hose 30 is slipped and held in place by hose clamp 34 or other suitable means.

In FIG. 2, the distal end of the hose 30 and the holder 10 are shown in cross section to reveal details of the construction thereof. As will be noted, disk 22 has a diameter slightly larger than the outside diameter of hose 30. Fixed end cap disk 16 shown in phantom view recesses in the proximal end connector 36. Spring 33 in hose 30 tends to extend hose 30 against disks 22 and 16. As will be apparent from FIG. 2, removable end cap disk 22 includes several openings 21. When a hose 30 is installed on holder 10 after use, it will usually contain a small amount of water left after flushing and rinsing. Openings 21 permit air circulation to cause evaporation thereby preventing mustiness or odors from building up.

Handle 20 is shown including a swivel portion 23 such that handle 20 may be folded downward when a hose is to be stored in a compartment. In the event it is desired to hang the stored hose on a hanger, ring handle 20 is suitable for such purpose. In addition, handle 20 permits easy caring of the hose in the stored position, although other types of handles may be used.

To install a hose 30 on my holder 10, the user uncouples the hose from the recreational vehicle and from the central sewage treatment system and rinses it out in conventional fashion. The removable end cap disk is removed from holder 10, and the proximal end of hose 30 is passed over core 12 and the connector 36 is seated onto fixed end cap disk 16. The proximal end of the holder 10 may then be held against the user's body and the hose quickly and conveniently fed onto the core until fully compressed. At that point, the user installs the removable end cap disk 22 and threads wing nut 24 onto rod distal end 19.

Figure 3:
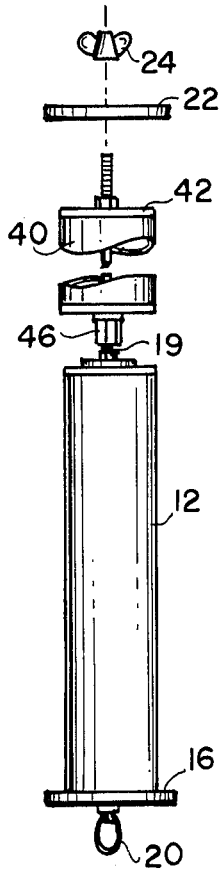
FIG. 3 is a partially cut away view of a holder in accordance with my invention having an extending core section added thereto.

Accordion type hose 30 is available in various lengths with 20 feet being a typical length. When fully compressed, a 20 foot hose may have a retracted length of about 2 feet. Thus, in this case, core 12 would be selected to have a length of approximately 2 feet. If a longer hose is to be used with a particular holder 10, the core may be extended as illustrated in FIG. 3 by the use of an extender core 40 of any desired length having a cap disk 42 cemented thereto. A short threaded extension rod 44 may be disposed axially through extender core 40 and attached to distal end 19 by means of a threaded coupling 46. Thus, for economy of manufacture, a holder may be made with a standard short length and extender cores 40 provided for longer hoses.

Although I have disclosed my invention with regard to a specific construction, it will be apparent that various modifications can be made without departing from the spirit or scope of the invention. For example, different materials and different means of attaching the end cap disk are obvious changes than can be made.

I claim:

1. A holder for an accordion type hose having connectors attached to each end thereof comprising:

an elongated cylindrical core;

a fixed end cap disk concentric with and attached to a proximal end of said core;

a removable end cap disk concentrically attachable to the distal end of said core;

a handle attached to said proximal end of said core; and a rod attached to said handle and disposed axially through said fixed end cap disk, said core, and said removable end cap disk, said rod having a threaded distal end for receiving a nut.

2. The holder as recited in claim 1 in which the diameter of said fixed end cap disk is greater than the inside diameter of said hose and less than the inside diameter of said connectors.

3. The holder as recited in claim 1 in which the diameter of said removable end cap disk is greater than the outside diameter of said hose.

4. The holder as recited in claim 1 in which said handle is a ring.

5. The holder as recited in claim 4 in which said ring is attached to a swivel joint.

6. The holder as recited in claim 1 in which said core and said fixed and removable end cap disks are formed from plastic.

7. The holder as recited in claim 6 in which said plastic is polyvinyl chloride.

8. A device for holding and storing an accordion type cylindrical hose when not in use, said hose having a connector on one end thereof, comprising:

an elongate cylindrical core portion, said core portion having a diameter less than the interior diameter of said hose;

a fixed end cap disk concentrically attached to a proximal end of said core portion, said fixed end cap disk having a diameter to fit within one of said connectors;

a rod having a proximal end attached to a handle and having a threaded distal end, said rod disposed axially through said core portion such that said handle is adjacent said fixed end cap disk;

a removable end cap disk concentrically installed on said threaded distal end of said rod, said removable end cap disk having a diameter greater than the outside diameter of said hose; and a removable nut threaded on said distal end of said rod for holding said removable disk in place whereby said accordion type hose in its retracted condition is disposed over said core portion and between said fixed end cap disk and said removable end cap disk.

9. The device as recited in claim 8 in which said core portion and said fixed and removable end caps are formed from plastic.

10. The device as recited in claim 9 in which said plastic is polyvinyl chloride.

11. An adjustable length holder for an accordion type hose having a connector attached to one end thereof comprising:

a first elongated cylindrical core;

a fixed end cap disk concentric with and attached to a proximal end of said first core;

a removable end cap disk concentrically attachable to the distal end of said first core;

a handle attached to said proximal end of said first core;

a primary rod attached to said handle and disposed axially through said fixed end cap disk, and said first core, said rod having a threaded distal end;

a second elongated cylindrical core;

a secondary threaded rod attachable to said primary rod to provide an extension thereof; and a nut for holding said removable end cap disk to the distal end of said first core in a first configuration, and for holding said removable end cap disk to the distal end of said second core, said second core disposed at the distal end of said first core, said secondary rod attached to the distal end of said primary rod and extending axially through said second core, and said removable end cap disk for receiving said nut in a second configuration.

* * * * *